US012655609B2

(12) United States Patent
Wei et al.

(10) Patent No.: US 12,655,609 B2
(45) Date of Patent: Jun. 16, 2026

(54) AUXILIARY POWER SYSTEM FOR AN EXCAVATING MACHINE

(71) Applicant: Caterpillar Inc., Peoria, IL (US)

(72) Inventors: Mo Wei, Dunlap, IL (US); Xinyu Ge, Peoria, IL (US); Jia J. Li, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 226 days.

(21) Appl. No.: 18/497,712

(22) Filed: Oct. 30, 2023

(65) Prior Publication Data

US 2025/0137222 A1 May 1, 2025

(51) Int. Cl.

| | |
|---|---|
| ***E02F 9/20*** | (2006.01) |
| ***E02F 3/32*** | (2006.01) |
| ***E02F 3/42*** | (2006.01) |

(52) U.S. Cl.

CPC ..... *E02F 9/2091* (2013.01); *E02F 3/32* (2013.01); *E02F 3/425* (2013.01)

(58) Field of Classification Search

CPC ..... E02F 9/2029; E02F 9/2091; E02F 5/305
See application file for complete search history.

(56) References Cited

U.S. PATENT DOCUMENTS

| | | | | |
|---|---|---|---|---|
| 6,635,973 | B1 | 10/2003 | Kagoshima et al. | |
| 9,376,116 | B1 * | 6/2016 | Ge | F16F 15/02 |
| 9,548,615 | B2 | 1/2017 | Takeo | |
| 9,802,600 | B2 | 10/2017 | Nanjo et al. | |
| 10,030,363 | B2 | 7/2018 | Imura et al. | |
| 2008/0264051 | A1 | 10/2008 | Ericson et al. | |
| 2012/0303224 | A1 * | 11/2012 | Keefer | E02F 3/304 701/50 |
| 2014/0147238 | A1 | 5/2014 | Izumi et al. | |
| 2019/0345695 | A1 | 11/2019 | Kumeuchi et al. | |
| 2020/0024828 | A1 * | 1/2020 | Asada | E02F 3/437 |
| 2021/0301500 | A1 * | 9/2021 | Metzger | F04B 49/06 |

(Continued)

FOREIGN PATENT DOCUMENTS

| | | | |
|---|---|---|---|
| CN | 201713841 | U | 1/2011 |
| CN | 108678064 | B2 | 12/2018 |

(Continued)

OTHER PUBLICATIONS

Hippalgaonkar, Rohit, Optimal Power Management of Hydraulic Hybrid Mobile Machines—Part I: Theoretical Studies, Modeling and Simulation, May 2016, ASME, Journal of Dynamic Systems, Measurement, and Control (Year: 2016).*

(Continued)

*Primary Examiner* — Erin D Bishop
*Assistant Examiner* — Alex B Griffin

(57) ABSTRACT

An excavating machine can conduct an excavation cycle that can be distinguished in a plurality of work cycle segments. To maneuver an excavation tool with respect the work surface during the excavation cycle, the excavation machine includes an excavation linkage powered by a primary electrical power source. The excavation machine can be operatively associated with a battery management system that can identify a high load condition associated with the excavation cycle and can responsively connect an auxiliary electrical power source to the hydraulic system to delivery supplemental power during the high load condition.

20 Claims, 5 Drawing Sheets

(56) References Cited

U.S. PATENT DOCUMENTS

| | | | | |
|---|---|---|---|---|
| 2022/0355678 | A1* | 11/2022 | Seo | E02F 9/2091 |
| 2023/0417019 | A1* | 12/2023 | Kitahara | E02F 9/207 |

FOREIGN PATENT DOCUMENTS

| | | | |
|---|---|---|---|
| KR | 20120127911 | A | 11/2012 |
| KR | 20140137499 | A | 12/2014 |
| KR | 20220090256 | A | 6/2022 |
| KR | 20220090644 | A | 6/2022 |
| WO | WO 2013/146204 | A1 | 10/2013 |

OTHER PUBLICATIONS

Custom Truck One Source, 3 Useful Tips for Digging Into Frozen Ground This Winter, Feb. 1, 2021 (Year: 2021).*

Written Opinion and International Search Report for Int'l. Patent Appln. No.PCT/US2024/046312, mailed Dec. 19, 2024 (10 pgs).

* cited by examiner

AUXILIARY POWER SYSTEM FOR AN EXCAVATING MACHINE

TECHNICAL FIELD

This patent disclosure relates generally to an electrically powered excavating machine for a material moving operation and, more particularly, to an excavating machine including an auxiliary power source for high load conditions.

BACKGROUND

Earth moving and material handling operations may rely on different types of equipment and machinery for digging and excavating the material of interest, physically moving the material, and dumping or loading the material at another location. An excavating machine, also referred to as an excavator, is a type of machine used in such excavating operations. Excavators can include an elongated mechanical linkage with an excavating tool like a bucket attached at the distal end that can be spatially maneuvered by articulation of the linkage to dig and transport the material. Articulation of the linkage can be powered by hydraulic actuators and an associated hydraulic system to provide pressurized hydraulic fluid, although in some embodiments, a series of cables that are reeled in or paid out by an electrical motor may be utilized. Other examples of machines that may be used in excavating operations include dozers, wheel or track loaders, and the like.

The excavating machine may be a mobile machine that includes one or more traction/propulsion devices like continuous tracks or wheels for travel about a worksite to access the material to be excavated. To power the traction/propulsion devices, the excavating machine can be equipped with a power plant or power source. While traditional configurations could use internal combustion engines as the power source, more recently excavating machines using electrical power sources such as rechargeable batteries have become common. In addition to powering the traction/propulsion devices, the electrical power source may provide power to articulate the excavation linkage. The power requirements for mobile travel of the excavation machine via the traction/propulsion devices and for excavating material by articulation of the excavation linkage may differ significantly and may exert different electrical loads on the electrical power source. The present disclosure is directed to systems and methods for assessing and matching the different power requirements.

SUMMARY

The disclosure describes, in one aspect, an excavating machine including a machine frame supported on a plurality of traction/propulsion devices. Connected to the machine frame is an excavation linkage having an excavation tool at the distal end. The excavation linkage is configured for movable articulation of the excavation tool with respect to the work surface through an excavation cycle that is characterized by at least one high load condition. A hydraulic system is operatively associated with and configured to hydraulically power movable articulation of the excavation linkage. To power the plurality of traction/propulsion devices and the hydraulic system associated with the excavation linkage, the excavation machine includes a primary electrical power source. The excavation machine can also include an electronic controller programmed to identify the high load condition of the excavation cycle and to direct an auxiliary electrical power source to provide supplemental power to the hydraulic system during the high load condition.

In another aspect, the disclosure describes a method of operating an excavating machine during an excavation cycle. The method directs electrical power from a primary electrical power source to a hydraulic system operatively associated with and configured to hydraulically power movable articulation of an excavation linkage having an excavation tool with respect to a work surface. During the excavation cycle, the method can identify a high load condition on the primary electrical power system. In the event of a high load condition, the method discharges an auxiliary electrical power system to provide supplemental power to the hydraulic system.

In yet another aspect, the disclosure describes an excavating machine including an excavation linkage configured for movable articulation of an excavation tool with respect to a work surface during an excavation cycle. To power articulation of the excavation linkage, the linkage is operatively associated with a hydraulic system that is connected to a primary circuit including a primary electrical power source. The excavation machine also includes an auxiliary circuit including an auxiliary electrical power source selectively connected to the hydraulic system though an electric switch. An electronic controller is programmed with a battery management system to receive electronic data indicative of the excavation cycle from the sensor, to identified a high load condition applied to the primary electrical power source during the excavation cycle from the electronic data, and to selectively connect the auxiliary circuit via the electric switch to deliver supplemental power to the hydraulic system during the high load condition.

DETAILED DESCRIPTION

Figure 1:
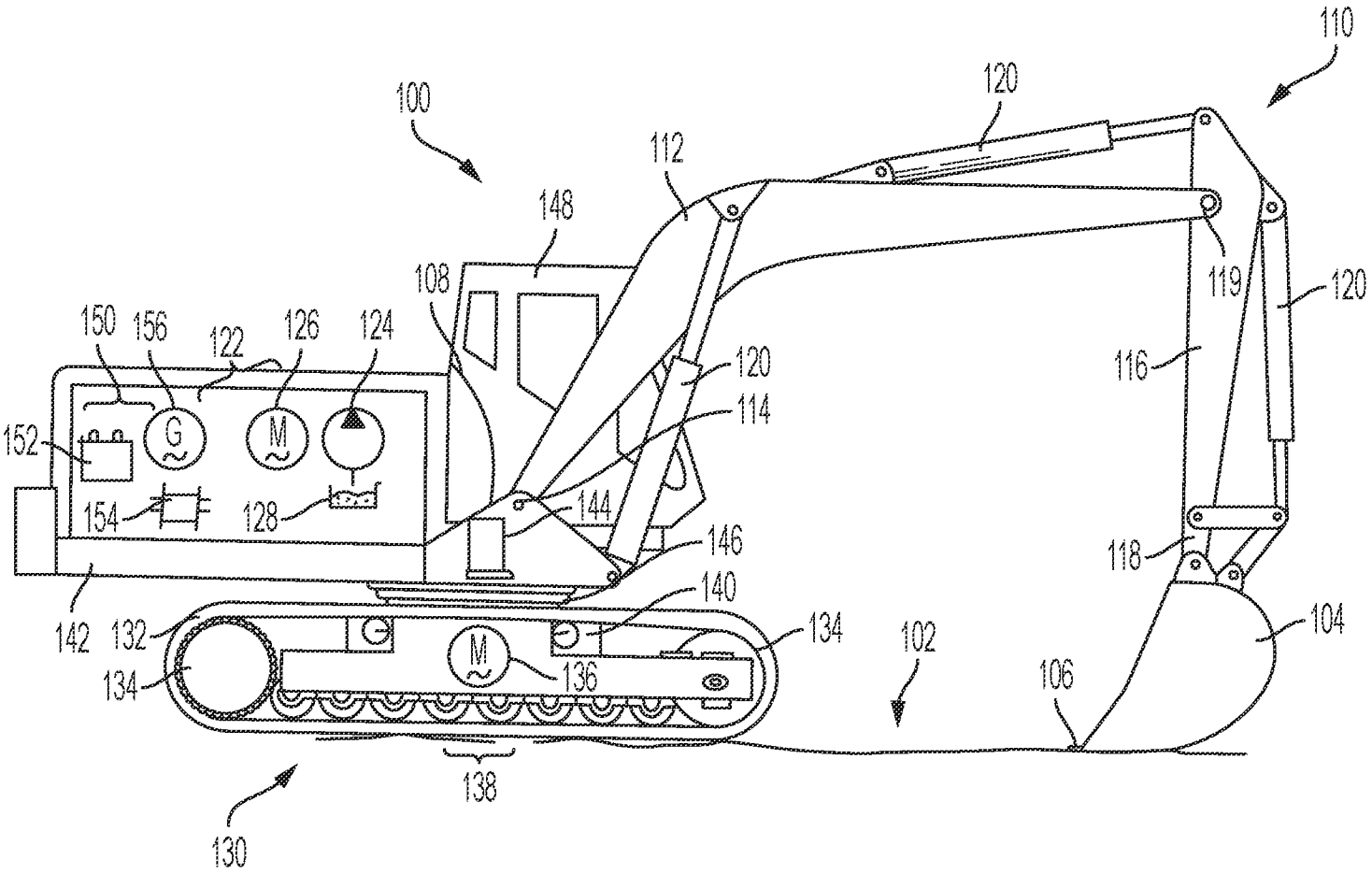
FIG. 1 is a side elevational view of an example of an excavating machine such as a hydraulic excavator for earth moving operations that includes an electric powertrain.

Now referring to the drawings, wherein whenever possible like reference numbers refer to like features, there is illustrated in FIG. 1 an example of an excavating machine 100 in the embodiment of a hydraulic excavator for digging and loading earthen materials and similar matter from the work surface 102 of a worksite. To penetrate the work surface 102 and accommodate the earthen soil or construction material, the excavating machine 100 includes an excavating tool in the form of a bucket 104 that is shaped to define an opened volume and a cutting or leading edge 106 at its furthermost tip. The excavating machine 100 can range in various sizes from compact excavators to excavators used in mineral extraction. In addition to an excavating machine 100 equipped with a bucket 104, other examples of excavating machines suitable for earthmoving operations can include dozers, wheel or track loaders, graders, hammers and the like. In another embodiment, the excavating machine may take the form of an attachment that can be operatively coupled to another type machine such as a loader. Furthermore, aspects of the disclosure may be applicable to other types of machines for conducting operations associated with an industry such as mining, construction, farming, transportation, and the like.

Figure 2:
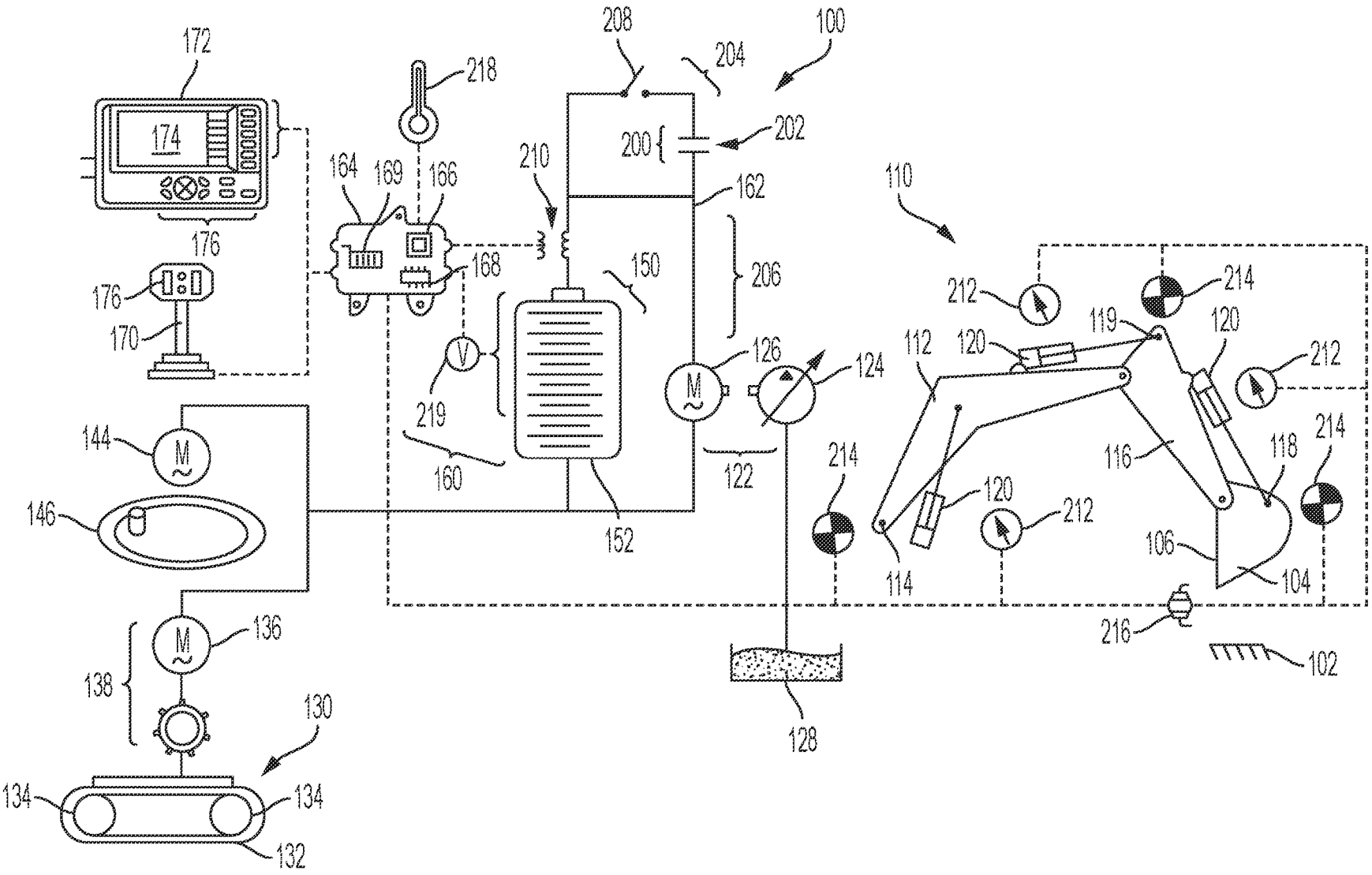
FIG. 2 is a schematic representation of the operational systems of the excavating machine including a primary electrical power source and an auxiliary electrical power source.

Referring to FIGS. 1 and 2, to extend, retract, and maneuver the bucket 104 with respect to the work surface 102, the bucket 104 can be operatively attached to a machine frame 108 of the excavator by an excavation linkage 110. The excavation linkage 110 can be a mechanical assembly of rigid links that are movably connected by mechanical joints so that the assembly can articulate with respect to itself. For example, the excavation linkage 110 can include an elongated arm or boom 112 that is pivotally connected to the machine frame 108 at a proximal end joint 114 of the linkage and a second elongated arm or dipper stick 116 that is pivotally joined to the bucket 104 at the distal end joint 118 of the linkage. The boom 112 and the dipper stick 116 can be made from rigid structural steel and can be pivotally connected together by a revolute arm joint 119 so that the elongated links can articulate with respect to each other.

To cause the boom 112, dipper stick 116, and bucket 104 to articulate with respect to each other, the excavation linkage 110 can be operatively associated with one or more hydraulic actuators 120 such as, for example, hydraulic cylinders that can telescopically extend and retract an elongated rod attached to a piston movably accommodated in a cylinder body thereby resulting in lifting, tilting, and other motions. For example, the excavation linkage 110 can include a boom actuator, a stick actuator, and a bucket actuator operatively arranged to pivotally articulate the rigid linkages that correspond to the boom 112, the dipper stick 116, and the bucket 104. To provide pressurized hydraulic fluid for use by the hydraulic actuators 120, the excavating machine 100 can be associated with a hydraulic system 122 including a hydraulic pump 124 that is powered by an electric pump motor 126 that are disposed on the machine frame 108. The hydraulic pump 124 can be supplied hydraulic fluid from a hydraulic reservoir 128 or tank. The hydraulic pump 124 can be any suitable type of volumetric fluid displacement pump such as a gear pump, piston pump, swash plate, and the like. The electric pump motor 126 can convert electricity in the embodiment, for example, of direct current to rotational motion and torque and is operatively coupled to the hydraulic pump 124 through rotatable shafts.

To enable the excavating machine 100 to travel over the work surface 102 at the worksite, the machine frame 108 can be supported on a plurality of traction/propulsion devices 130. By way of example, the traction/propulsion devices 130 can be continuous tracks 132 that extend about one or more rotatable drive gears 134 that cause the tracks to traverse with respect to the work surface 102. In another example, the traction/propulsion devices 130 can be rotatable pneumatic wheels. To power the traction/propulsion devices 130, an electric traction motor 136 can be disposed on the machine frame 108 to convert DC electricity to a rotational motive output and torque. To vary the rotational speed and or direction, and relatedly the torque output, of the traction motor 136, the traction motor can be an operative component of a traction electric powertrain 138 that may include components like transmissions, differentials, etc.

In an embodiment, the excavating machine 100 can be configured to swing the excavation linkage 110 with respect to the work surface 102 as part of the excavation work cycle. For example, the machine frame 108 can be assembled from an undercarriage 140 that is associated with the traction/propulsion devices 130 and a platform 142 that is situated above the undercarriage 140. The undercarriage 140 and the platform 142 are coupled by a swing drive motor 144 and a ring gear 146 that rotate the excavation linkage 110 to different locations over the work surface 102 during an excavation operation.

To operate the excavation machine 100, the platform 142 can include an onboard operator station 148 or operators cab to accommodate an operator. The excavation machine 100 can also be configured for autonomous, semi-autonomous, or remote operation. In autonomous operation, the excavating machine 100 may utilize various sensors and controls to conduct operations without human interaction. In semi-autonomous operation, a human operator may conduct some of the tasks and assume some control over the excavating machine 100, while the excavating machine itself may be responsible for other operations. In remote configurations, the operator may be located off-board and away from the excavating machine 100 and control it through a remote control system.

In an embodiment, to generate power for operation of the excavating machine 100, a power plant in the form of a primary electrical power source 150 can be disposed on the machine frame 108. The primary electrical power source 150 can be the primary driver of the traction/propulsion devices 130 connected through the traction electric powertrain 138 for mobility of the excavating machine 100. To generate electric power to transmit through the traction electric powertrain 138, the primary electrical power source 150 can be embodied as any suitable source of electrical energy to provide and supply electrical power in the form of electrical current and voltage to a load. The primary electrical power source 150 can produce electrical power as either direct current or alternating current, and the alternating electrical current can be single phase or polyphase electricity. The primary electrical power source 150 can produce electrical power utilizing any suitable technology and operating principle include electromagnetic, thermodynamic, chemical, solar, etc.

The primary electrical power source 150 can be, for example, a battery pack 152 comprised of a plurality of electro-chemical battery cells that function as an energy storage system for electricity. The battery pack 152 can store and supply direct current electricity and the individual battery cells that can be secondary rechargeable cells cable of being periodically charged, discharged, and recharged. In other embodiments, the primary electrical power source 150 can be a fuel cell 154 that converts the chemical energy of a fuel such as hydrogen into electrical energy. In yet another example, the electrical power source 150 can be an electrical generator 156 that is coupled to the output shaft of the internal combustion engine to receive motive power in the form of rotational torque. A generator 156 converts motive power embodied as rotational motion into electrical power in the form of alternating electrical current that can be converted to direct current using a power converter. As described below, operation of the primary electrical power source 150 can be regulated in part by a battery management system 160, or a similar power management system.

To electrically connect the primary electrical power system 150 to the points of application, the excavation machine 100 can include a battery bus 162 comprised of conductive wires, power cables and the like for the transmission of electricity. For example, the battery bus 162 can connect the primary electrical power system 150 to the pump motor 126 associated with the hydraulic pump 124. The battery bus 162 can also be in electrical communication with the traction motor 136 to power the traction/propulsion devices 130 and the swing drive motor 144 to swing the platform 142 with respect to the undercarriage 140.

To regulate the transmission and distribution of electric power on the battery bus 162, the battery management system 160 associated with the excavating machine 100 can be embodied by an electronic controller 164. The electronic controller 164 can include various circuitry components in any suitable computer architecture for receiving and processing data and software to operate. The electronic controller 164 can process and execute different functions, steps, routines, and instructions written as computer readable software programs and may use data from sources such as data tables, charts, data maps, lookup tables and the like. Additionally, the electronic controller 164 can be responsible for processing functions associated with various other systems on the mobile machine. While the electronic controller 164 is illustrated as a standalone device, its functions may be distributed among a plurality of distinct and separate components.

For example, the electronic controller 164 can include one or more microprocessors 166 such as a central processing unit (CPU), an application specific integrated circuit (ASIC), or a field programmable gate array (FPGA) comprising a plurality of transistors and similar circuits that are capable of reading, manipulating and outputting data in electronic form. The electronic controller 164 can include non-transient programmable memory 168 or other data storage capabilities such as random access memory or more permanent non-volatile forms of data storage media. Common examples of computer-readable memory 168 include RAM, PROM, and EPROM, a FLASH-EPROM, and any other memory chip or cartridge. The memory is capable of storing in software form the programming instructions and the data that can be read and processed by the microprocessor 164. The software and data may take the form of instruction sets, programs, applications, routines, libraries, databases, lookup tables, data sets, and the like. To communicate with other instruments and actuators associated with and electrically connected to the battery bus 162, the electronic controller 164 can include various input/output cards 169 and related circuitry. Communication may be established by sending and receiving digital or analog signals across electronic communication lines or communication busses using any suitable data communication protocols, including wireless protocols.

To interface with an operator of the excavation machine 100, the electronic controller 164 can be operatively associated with and communicate with one or more operator interface devices. For example, to receive operator commands to maneuver the traction/propulsion devices 130 and the excavation linkage 110 during operation, operator input devices 170 such as joysticks can be included onboard in the operator station 148 or off-board for remote control. During excavation, the joystick can be pivoted in multiple directions, and the movements of the joystick triggered by an operator are converted to electronic signals to the electronic controller 164 that adjust operation of the hydraulic system 122 to lift, lower, extend and/or retract the excavation linkage 110 with respect to the work surface 102. In addition to a joystick, other examples of input devices for maneuvering may include steering wheels, gear sticks, and the like.

To further interface with the operator, a display device in the embodiment of a human-machine interface (HMI) 172 can be included. The HIM 172 can include visual display screen 174 such as an LCD screen that may have touch screen capabilities. Information regarding operation of the excavating machine 100 can be visually presented on the visual display screen 174 for the operator such as the operating speed of various systems, operational settings like gear selection, and the relative position and location of various structures like the excavation linkage 110 and the angular position of the platform 142. To receive operational settings, the HMI 172 may also include inputs 176 like buttons, keys, dials, etc. Inputs 176 can also be located on the operator input devices 170 such as the joystick.

The battery management system 160 via the electronic controller 164 can regulate and direct the supply of electrical power on the battery bus 162 in response to various operations of the excavating machine 100 during an excavation cycle. For example, referring to FIGS. 3A and 3B, the excavation cycle 180 for an excavating machine 100 can be distinguished into a plurality of distinct sequential functions by which the excavation machine can dig and load earthen material to a haul truck 182 or another location for deposit of the material. The maneuver segments can be conducted manually by an operator, semi-autonomously, or fully autonomously.

By way of example, the excavation cycle 180 can be begin with a dig-stroke segment 184 in which the bucket 104 is moved adjacent to the plane of the work surface 102 at the worksite by manipulation of the excavation linkage 110. At the beginning of the dig-stroke segment 184, the leading edge 106 of the bucket 104 may be in abutting contact with the plane of the work surface 102. The dig-stroke segment 184 may also be distinguished into a plurality of sub-segments. For example, referring to FIG. 3A, the excavation linkage 110 is hydraulic powered to vertically drive the cutting edge 106 of the bucket 104 into and penetrate the work surface 102, which may be referred to as the penetration or break-in sub-segment 186. The break-in sub-segment 186 can be characterized by relatively large forces necessary to initiate penetration of the work surface 102, thereby requiring the excavating machine 100 to generate a correspondingly large quantity of power for maneuvering the excavation linkage 110.

The dig-stroke segment 184 can continue by moving the bucket 104 along and vertically into the work surface 102 toward the excavating machine 100 thereby filling the bucket with material in what can be referred to as a dig-in sub-segment 188. Once the bucket 104 is moved proximate to the excavating machine 100 and the dig-in sub-segment 188 is compete, the bucket 104 may be vertically lifted from the work surface 102 to remove the excavated material in what can be referred to as loaded lift sub-segment 190. The bucket 104 can also be angularly curled with respect to the excavation linkage 110 to better situate the material therein.

Figure 3B:
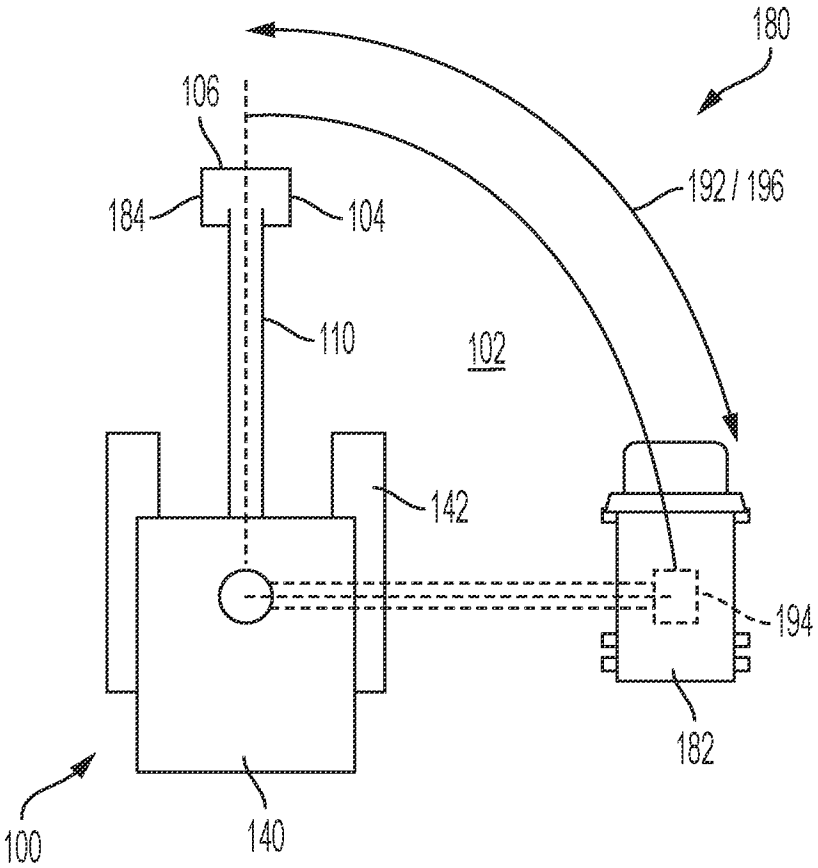
FIGS. 3A and 3B are schematic block diagrams of a plurality of work cycle segments conducted by the electrical operating machine during an excavation cycle.
Figure 3A:
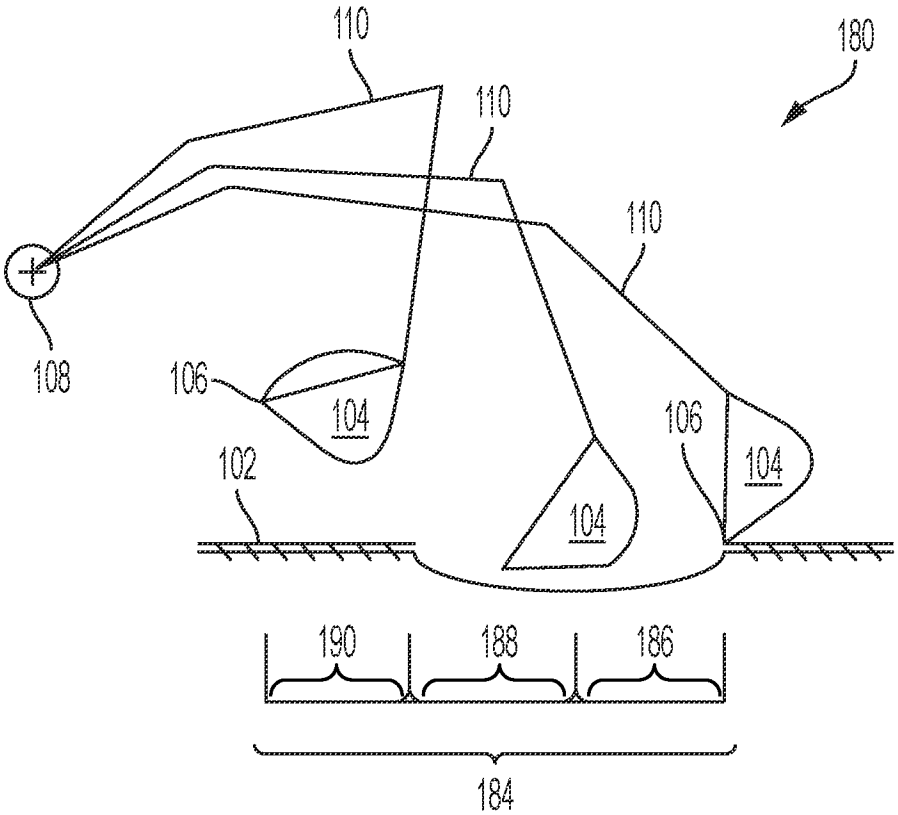

When the bucket 104 is filled with the material, the excavation cycle 100 can include a loaded swing segment 192 to maneuver the bucket from the location of the dig-stroke segment 184 toward the haul truck 182. Referring to FIG. 3B, during the loaded swing segment 192, the platform 142 is rotated with respect to the undercarriage 140 about the vertical axis of the excavation machine 100 by the swing machinery. When the bucket 104 is positioned over the haul truck 182 (indicated in dashed lines) the excavation cycle 300 can include a dump segment 194 in which the bucket 104 is pivoted with respect to the excavation linkage 110 to release the material therein. After the bucket 104 has been empty to the haul truck 182, the excavation cycle 180 includes an empty swing segment 196 in which the platform 142 rotates the excavation linkage 110 again with respect to the work surface 102 to position the bucket 104 for the next dig-stroke segment 184.

Figure 4:
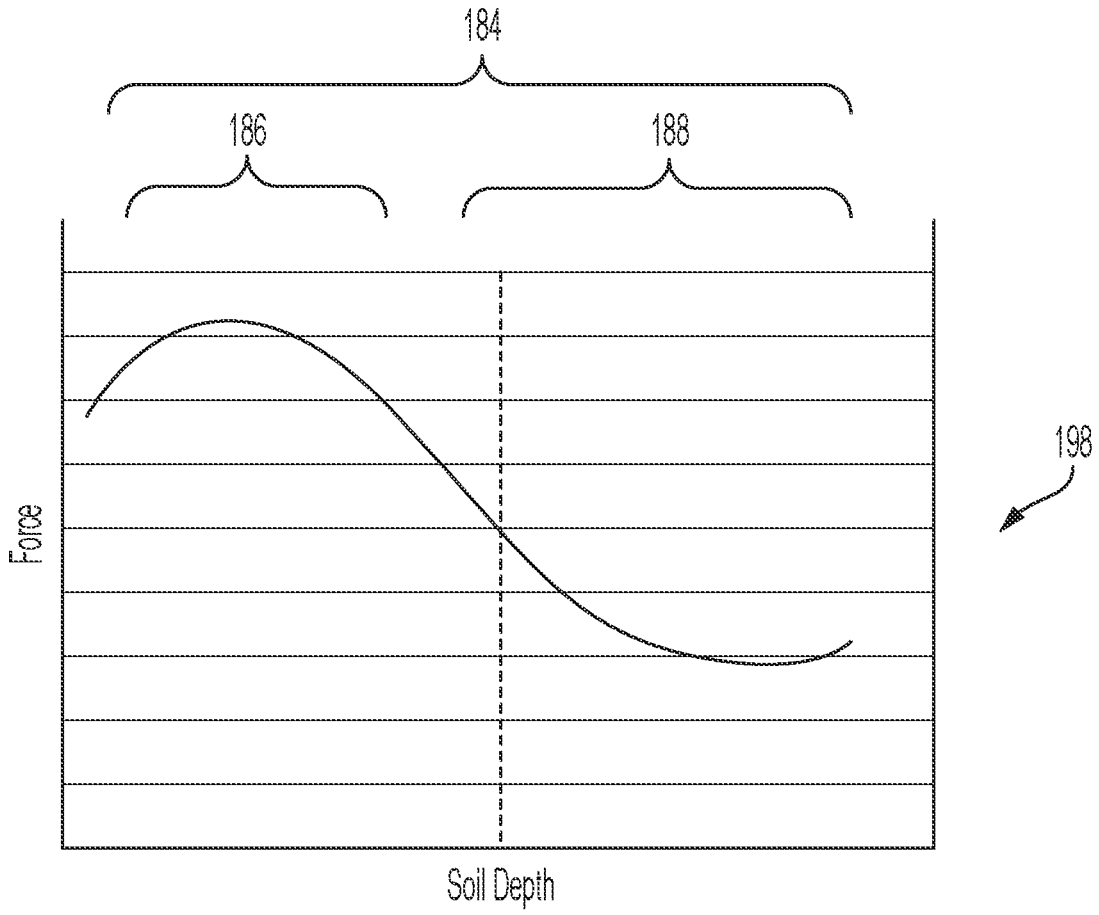
FIG. 4 is a chart of the electrical power usage of the electrical excavating machine during the excavation cycle of FIG. 3.

The different segments of the excavation cycle 180 are associated with different force and power requirements. For example, during the break-in sub-segment 186, the power requirements necessary to initially penetrate the work surface 102 may exceed those during other operational segments of the excavation cycle 180 such as the swing and dump segments 192, 194, 196. Referring to FIG. 4, with continued reference to the prior figures, there is illustrated a chart 198 depicting the force requirements on the Y-axis with respect to the segments of the dig-stroke segment 184 on the X-axis, which may be represented by soil penetration of the bucket 104 or time duration of the dig-stroke segment 184. At the break-in sub-segment 186 of the dig-stroke segment 184, the forces required may relatively large to drive the leading edge 106 of the bucket 104 into the work surface 102. By contrast, once the leading edge 106 has penetrated a sufficient depth into the work surface 102, the force requirements to move the bucket 104 through the material during the dig-in sub-segment 188 may lessen or abate. Furthermore, the environmental conditions associated with the worksite may affect the power requirements for conducting the break-in sub-segment 186. For example, the material properties may differ such as softer sand verses harder rock. The working environmental temperature can also affect the power requirements, with colder temperatures possibly below freezing causing the work surface 102 to be more resistant to the break-in sub-segment 186 of the dig-stroke segment 184. Once the leading edge 106 has penetrated below the frost line, however, the force requirements during the dig-in sub-segment 188 again lessen or abate.

To match the increased force requirements during the break-in sub-segment 186, the hydraulic output/pressure of the hydraulic system 122 is correspondingly increased to actuate the hydraulic actuators 120 accordingly. The power draw of the pump motor 126 is correspondingly increased which increases the electrical load on the primary electrical source 150 and thus the amount of electric current drawn from the battery pack 152. Operation of the primary electrical power source 150 to match the increased power and force requirements during the excavation cycle may be referred to as a high load condition. The battery management system 160 can be configured to responsively and efficiently control and regulate operation of the primary electrical power source 150 and related systems on the excavating machine 100 during the high load conditions.

For example, the increased power draw on the primary electrical power source 150 and the associated electrical current output communicated through the battery bus 162 can cause overheating or otherwise damage electrical components disposed in or electrically connected to the battery bus 162. To avoid overheating and damage due to excessive current, the battery management system 160 can apply threshold limits on the electrical load on the primary electrical power source 150 and thus the current drawn therefrom. Furthermore, application of an excessive electrical load can rapidly deplete the primary electrical power source 150 leaving insufficient energy for subsequent segments of the excavation cycle. In the embodiments wherein the primary electrical power source 150 is rechargeable, rapid depletion and subsequent recharging of the battery pack 152 can decrease the cycle life.

To enable the battery management system 160 to accommodate the increased power demand during the high load conditions of the excavation cycle, an auxiliary electrical power source 200 can be included with the excavation machine 100. In an embodiment, the auxiliary electrical power source 200 can be a capacitor 202 designed for the temporary storage of electrical energy when operatively connected to a direct current electrical circuit. In a specific embodiment, the capacitor 202 may be a super capacitor with significant storage capacity and delivery of electrical power during a charge-and-discharge cycle. The capacitor 202 can be constructed with opposing conductive electrodes separated by a non-conductive dielectric or electrolyte. During charging, an electrical charge builds between the separated electrodes. During discharge, the circuit is reconfigured and the charge is withdrawn from the electrodes as current thereby providing auxiliary power during the high load condition. In addition to a capacitor, examples of an auxiliary electrical power source 200 include secondary batteries, fuel cells, and other temporary electrical power storage systems.

Referring to FIG. 2, the auxiliary electrical power source 200 can be physically connected in an auxiliary circuit 204 in common with the primary electrical power source 150 and the pump motor 126 of the hydraulic system 122 by the conductive battery bus 162. For example, the auxiliary circuit 204 can be arranged in series with a primary circuit 206 of the battery bus 162 that establishes electrical communication between the primary electrical power source 150 and the pump motor 126.

To selectively establish electrical communication with the devices, the auxiliary electrical power source 200 can be associated with an electric switch 208. The electric switch 208 can be toggled opened or closed to complete or interrupt the electrical connection between the auxiliary electrical power source 200, the primary electrical power source 150, and the pump motor 126. For example, when the electric switch 208 is in the closed state, the auxiliary electrical power source 200 is electrically connected to and communicates with the primary electrical power source 150 to receive electrical current therefrom and is thereby charged. When the electric switch 208 is in the opened state, the electrical connection between the auxiliary electrical power source 200 and the primary electrical power source 150 is interrupted. Because the auxiliary electrical power source 200 is still connected in series with the pump motor 126, the stored electrical power in the capacitor 202 is discharged to the pump motor. The electrical power discharged to the pump motor 126 in the embodiment of electric current supplements the power supplied by the primary electrical power source 150 increasing the torque and mechanical output of the pump motor 126 to the hydraulic system 122 during the high load conditions.

To facilitate selective use of the auxiliary electrical power source 200, the battery management system 160 can be configured to identify if the excavation cycle is in or corresponds to a high load condition. In particular, the electronic controller 164 can be programmed to process and analyze information and data about operation of the excavating machine during the excavation cycle that is provided by a plurality of sensors. A sensor can be a physical device capable of sensing and/or measuring a physical condition or characteristic of the surrounding environment and communicating that information to the electronic controller 164 as electronic data signals. For example, because the high load condition corresponds with a significant power and current draw on the primary power source 150, a power or current sensor 210 can be electrically connected into the battery bus 162 at a location that measures the current flow out of the battery pack 152. The power or current sensor 210 can also be in electrical communication with the electronic controller 164 to send and receive electronic data signals, as indicated by dashed lines.

As another example, the sensors may include fluid pressure sensors 212 that are disposed to measure the hydraulic pressure in the plurality of hydraulic actuators 120 associated with the excavation linkage 110. In the embodiment wherein the hydraulic actuators 120 include a boom actuator, a stick actuator, and a bucket actuator, the pressure sensors 212 can include a corresponding boom pressure sensor, a dipper-stick pressure sensor, and a bucket pressure sensor. The hydraulic pressure in the hydraulic actuators 120 can be indicative of the forces and counterforces applied by and to the excavation linkage 110, which can be proportional to the hardness of the work surface 102 and thus the power requirements of the excavating operation.

In another example, the sensors may be location or position sensors operatively associated with the excavation linkage 110 to sense and determine its position relative to, for example, the work surface 102. In an embodiment, the position sensors can be rotary encoders 214 that measure the relative angular displacement between two rigid links, for example, the boom 112 and the dipper stick 116. To determine the positional and locational arrangement of the excavation linkage 110, rotary encoders 214 can be operatively associated with each of the proximal end joint 114, the distal end joint 118, and the revolute arm joint 119. The electronic controller 164 can be pre-programmed with geometric and dimensional data stored in memory 168 that can be applied with the data from the rotary encoders 214 using kinematic equations to determine the relative position and motion of the bucket 104 which allows the electronic controller 164 to assess the current operational segment of the excavation cycle. In another example, the position sensors can include an elevation proximity sensor 216 that is capable of measuring the relative vertical positions of the cutting edge 106 of the bucket 104 and work surface 102, which the electronic controller 164 can process to estimate the current segment of the excavation cycle.

Because the environmental conditions may affect the power requirements during the excavation cycle, the battery management system 160 may account for data and variables related to those conditions. For example, because frozen ground is more resistant to pentation by the bucket 104, a temperature sensor 218 can operatively communicate with the electronic controller 164 to sense and provide the working environment temperature associated with the work surface 102. Likewise, because the hardness of the material associated with the work surface 102 varies, information about that characteristic can be input to the electronic controller 164, for example, by using the inputs 176 on the operator input 170 and/or the HMI 172. Material information may include identification about the material such as sand or rock which is being excavated. In addition information in the form of electronic data signals can be provided to the electronic controller 164 from a meter 219 such as a voltage meter or current meter associated with the primary electrical power source 150 that is indicative of the electrical power stored therein.

INDUSTRIAL APPLICABILITY

Figure 5:
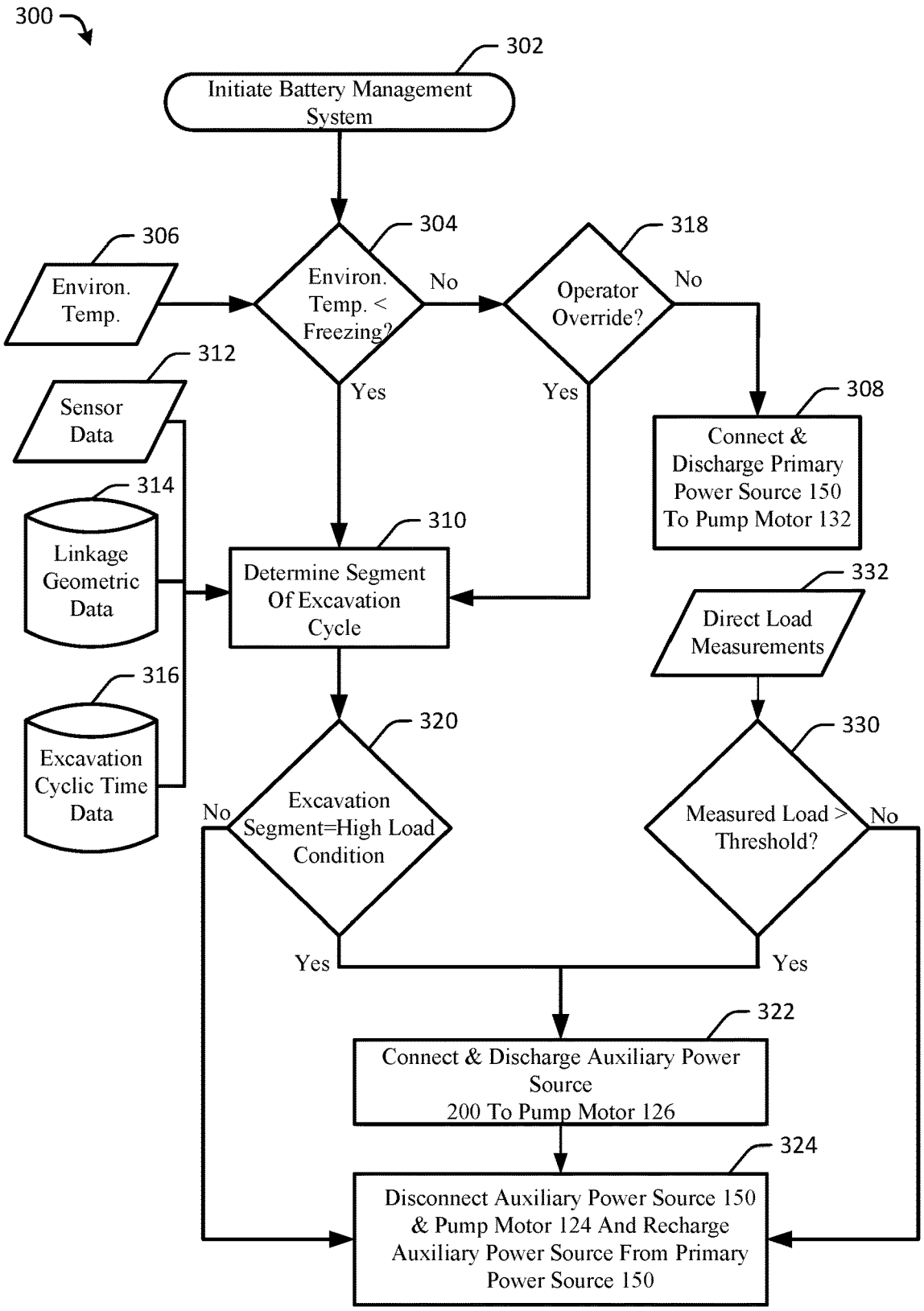
FIG. 5 is a flow diagram representing operation of the electrical excavating machine during an excavation operation utilizing a power management control system for selective use of the primary and auxiliary electrical power sources.

Referring to FIG. 5, with continued reference to the preceding figures, there is illustrated an embodiment of a process 300 of conducting an excavation cycle that may selectively use the auxiliary electrical power source 200 to supplement or substitute for the primary electrical power source 150 during high load conditions. The process 300 may correspond to the battery management system 160 and can be embodied as a series of computer programmable steps and functions written in a software programming language that may be processed by the electronic controller 164. The process 300 may be initiated at a starting step 302 in which the battery management system 160 is activated by the electronic controller 164. The starting step 302 can occur automatically upon operation of the excavating machine 100 or may be selectively initiated by an operator.

In an embodiment, the process 300 can include a temperature decision step 304 to estimate the hardness of the work surface 102. For example, the process 300 can receive data signals representing the working environment temperature 306 from the temperature sensor 218. The temperature decision step 304 compares the working environment temperature 306 with a preset temperature value, for example, the freezing point of water which may indicate the soil at the work surface 102 is frozen. If the work surface 102 is not below the preset temperature value, indicating the work surface is not particularly resistant to penetration, the process 300 can proceed with a primary charging process 308 during which the primary electrical power source 150 is electrically connected to and discharges current to the pump motor 124 of the hydraulic system 122. Articulation of the excavation linkage 110 is powered through the excavation cycle 180 by the primary electrical power source 150.

If the temperature decision step 304 does, however, assess that the work surface 102 is likely resistant to penetration by the bucket 104, the process 300 proceeds to a segment determination step 310 that determines the current state of the excavation cycle 180. For example, the excavation segment determination step 310 can receive information in the form of sensor data 312 embodied as electronic data signals from the plurality of sensors operatively associated with the excavating machine 100 that are electronically communicated to the electronic controller 164. The sensor data 312 can include positional data from the rotary encoders 214 and the elevation proximity sensor 216. The electronic controller 164 can process the sensor data 312, using also geometric data 314 about the shape and dimensions of the excavation linkage 110, to determine the positional arrangement of, for example, the bucket 104 with respect to the work surface 102. The process 300 via the electronic controller 164 can associate the position of the bucket 104 with the start of a break-in sub-segment 186 of the dig-stroke segment 184 that is associated with the high load condition.

In another embodiment, the segment determination step 310 can use cyclic timing data 316 to determine if the excavation cycle is in or approaching a segment that corresponds to the high load condition. For example, in an autonomously configured excavating machine 100, the excavation cycle 180 can be conducted automatically and each segment can be preassigned fixed timing values which may be empirically measured. The cyclic timing data 316 can be communicated to the electronic controller 164 that, through the use of a timer or clock, may conduct the segment determination step 310 and assess the current operational segment of the excavation cycle 180 and whether it corresponds to a high load condition.

In an embodiment, the process 300 can also include an override decision 318 that allows an operator to input data signals using an input 176 on the operator input device 170 or HMI 172 to compulsorily compel the segment determination step 310. This may be advantageous when training an operator or during remote or autonomous operation.

In a charging decision step 320, the process 300 may assess if the current segment of the excavation cycle 180 as determined during the segment determination step 310 corresponds to the high load condition of the evacuation cycle. If the high load condition exists, the process 300 proceeds to a discharge process 322 in which the electronic controller 164 activates the auxiliary electrical power source 200 to supplement the power load on the primary electrical power source 150. The electronic controller 164 can accomplish the discharge process 322 by opening the electric switch 208 in the auxiliary circuit 204 to electrically connect and establish electrical communication between the capacitor 202 and the pump motor 124. The electrical charge stored in the auxiliary electrical power source 200 is communicated to the pump motor 124 in the form of increased electric current that correspondingly increases the torque output.

If the charging decision step 320 determines the current segment of the excavation cycle 180 does not correspond with a high load condition, the process 300 can proceed to a recharging process 324 to recharge the auxiliary electrical power source 200. For example, concurrent with the recharging process 324, the electronic controller 164 can move the electrical switch 208 to the closed position or similar configuration in which the auxiliary electrical power source 150 is electrically connected to the primary electrical power source 159 and, in the embodiment of a capacitor 202, is electrically charged for subsequent use during a high load condition.

In some embodiments, the discharge process 322 and the recharge process 324 may temporally occur for a predetermined time. For example, the break-in sub-segment 186 may occur and can be measured in a fixed time and the auxiliary electrical power source 200 can deliver supplemental power to the pump motor 124 for that period. Likewise, the auxiliary electrical power source 200 might recharge in a fixed time period at which point the recharge process 324 terminates to avoid overcharge. In other embodiments, the discharge and recharge processes 322, 324 can run their course until the auxiliary electrical power source 150 is completely discharge or recharged, or the electronic controller 164 can measure charge on the auxiliary power source 150 via the meter 219 to determine when the discharge and recharge processes 322, 324 should terminate.

In another embodiment, the process 300 can directly measure the forces and/or loads applied on and by the excavation linkage 110 to determine if the current segment of the excavation cycle corresponds to the high load condition. For example, in a direct measurement decision 330, the electronic controller 164 may make direct measurements 332 of the electric load and current draw on the primary electrical power source 150 using the power or current sensor 210 and of the forces exerted by the hydraulic actuator using the pressure sensors 212. The direct measurement decision 330 can compare the direct measurements 322 in terms of current or load with a load threshold, for example, that may reflect the operating limits of the electrical or hydraulic equipment on the excavating machine 100. If the direct measurements 332 exceed the load threshold, indicating the high load condition that may correspond to the break-in sub-segment 186 is occurring, the electronic controller 164 can initiate the discharge process 322 to cause the auxiliary electrical power source 200 to communicate supplemental power to the hydraulic motor 124. If the direct measurements indicate that the current segment of the excavating cycle does not correspond a high load condition, the direct measurement decision 330 can initiate the recharge process 324 to recharge the auxiliary power source 200.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. An excavating machine comprising:

a machine frame supported by on a work surface by a plurality of traction/propulsion devices;

an excavation linkage operatively attached at a proximal end to the machine frame and including an excavation tool coupled to a distal end of the excavation linkage, the excavation linkage configured for movable articulation of the excavation tool with respect to the work surface through an excavation cycle that is characterized by at least one high load condition, wherein the high load condition is characterized by an excessive current draw from a primary electrical power source above a threshold, wherein the threshold is based on potential damage to an electrical component of the excavating machine caused by the excessive current draw;

a hydraulic system operatively associated with and configured to hydraulically power movable articulation of the excavation linkage;

the primary electrical power source electrically connected to power the plurality of traction/propulsion devices and the hydraulic system;

an auxiliary electrical power source operatively connected to the hydraulic system to provide supplemental power to the hydraulic system; and an electronic controller programmed to identify the high load condition of the excavation cycle and to direct the auxiliary electrical power source to provide supplemental power to the hydraulic system.

2. The excavating machine of claim 1, wherein the excavation cycle includes a plurality of work cycle segments including a dig segment, a loaded swing segment, a dump segment, and an empty swing segment, and the high load condition corresponds to the dig segment.

3. The excavating machine of claim 2, wherein the dig segment includes a break-in sub-segment and a cut-in sub-segment, and the high load condition corresponds to the break-in sub-segment.

4. The excavating machine of claim 1, wherein the auxiliary electrical power source is a capacitor.

5. The excavating machine of claim 4, wherein the auxiliary electrical power source is selectively connectable with and rechargeable by the primary electrical power source.

6. The excavating machine of claim 5, wherein the primary electrical power source is a rechargeable battery pack.

7. The excavating machine of claim 6, wherein the hydraulic system includes a hydraulic pump operatively coupled to a pump motor.

8. The excavating machine of claim 1, further comprising a sensor in electronic communication with the electronic controller to assist identification of the high load condition.

9. The excavating machine of claim 8, wherein the sensor is a temperature sensor disposed to measure a working environment temperature indicative of the work surface.

10. The excavating machine of claim 8, wherein the sensor is one or more of a rotary encoder and an elevation proximity sensor.

11. The excavating machine of claim 8, wherein the sensor is a power sensor disposed to measure power draw on the primary electrical power source.

12. The excavating machine of claim 8, wherein the sensor is a pressure sensor disposed to measure hydraulic pressure in hydraulic actuator operatively associated with the hydraulic system.

13. The excavating machine of claim 1, wherein the primary electrical power source is disposed in a primary circuit and the auxiliary electrical power source is disposed in an auxiliary circuit which is arranged in parallel with the primary circuit.

14. A method for electrically powering an excavation machine during an excavation cycle comprising:

directing electrical power from a primary electrical power source to a hydraulic system operatively associated with and configured to hydraulically power movable articulation of an excavation linkage having an excavation tool with respect to a work surface during the excavation cycle;

identifying a high load condition on the primary electrical power source during the excavation cycle, wherein the high load condition is characterized by an excessive current draw from the primary electrical power source above a threshold, wherein the threshold is based on potential damage to an electrical component of the excavating machine caused by the excessive current draw; and discharging an auxiliary electrical power source to provide supplemental power to the hydraulic system during the high load condition.

15. The method of claim 14, further comprising recharging the auxiliary electrical power source with the primary electrical power source when the excavation cycle is not in the high load condition.

16. The method of claim 14, further comprising a step of measuring a working environment temperature; and a step of identifying the high load condition is contingent on the working environment temperature.

17. The method of claim 16, wherein the high load condition corresponds to a break-in sub-segment of the excavation cycle.

18. The method of claim 17, wherein the break-in sub-segment is identified via a relative spatial position of the excavation tool and the work surface.

19. The method of claim 14, wherein the high load condition is identified by a power sensor disposed to measure power draw on the primary electrical power source.

20. An excavating machine comprising:

an excavation linkage configured for movable articulation of an excavation tool coupled to the excavation linkage;

a hydraulic system operatively disposed to hydraulic power articulation of the excavation linkage during an excavation cycle;

a primary circuit including a primary electrical power source electrically connected to power the hydraulic system;

an auxiliary circuit including an auxiliary electrical power source selectively connected to the hydraulic system though an electric switch;

a sensor disposed to sense operating conditions relating to the excavation cycle; and an electronic controller in electronic communication with the sensor and programmed with a battery management system configured to:

receive electronic data indicative of the excavation cycle from the sensor;

identified a high load condition applied to the primary electrical power source during the excavation cycle from the electronic data, wherein the high load condition is characterized by an excessive current draw from the primary electrical power source above a threshold, wherein the threshold is based on potential damage to an electrical component of the excavating machine caused by the excessive current draw; and selectively connect the auxiliary circuit via the electric switch to deliver supplement power to the hydraulic system during the high load condition.

* * * * *